US006321467B1

(12) United States Patent
Tsen

(10) Patent No.: US 6,321,467 B1
(45) Date of Patent: Nov. 27, 2001

(54) SIZE-ADJUSTABLE OVERSHOES FOR GOLF SHOES

(76) Inventor: Chin Yu Tsen, No. 244, Hsing Tung Rd., Luo Tung Chen, I Lan Hsien (TW)

( * ) Notice: Subject to any disclaimer, the term of this patent is extended or adjusted under 35 U.S.C. 154(b) by 0 days.

(21) Appl. No.: 09/617,291

(22) Filed: Jul. 14, 2000

(51) Int. Cl.[7] ..... A43B 3/26

(52) U.S. Cl. ..... 36/97; 36/127; 36/7.3; 36/7.1 R

(58) Field of Search ..... 36/127, 97, 7.3, 36/8.2, 7 R, 135

(56) References Cited

U.S. PATENT DOCUMENTS 2,032,793 * 3/1936 Clark et al. .
2,970,390 * 2/1961 Brough et al. .
3,987,510 * 10/1976 Sbicca .
4,010,558 * 3/1977 Slusher .
4,183,157 * 1/1980 Counselman .
5,950,333 9/1999 Tsen ..... 36/7.1

* cited by examiner

*Primary Examiner*—Ted Kavanaugh
(74) *Attorney, Agent, or Firm*—Bacon & Thomas, PLLC

(57) ABSTRACT

A size-adjustable overshoe for golf shoe is provided. The overshoe includes a frame-like sole portion and a boot-shaped body portion. The sole portion is cut at proper positions into several segments and elastic connecting strips are used to connect the segments to one another. The body portion is connected to the sole portion with suitable fasteners, such as rivets. When the overshoe is worn over a differently sized golf shoe, the connecting strips automatically elastically change their length to adjust the size of the sole portion for the overshoe to fit on the golf shoe.

1 Claim, 5 Drawing Sheets

SIZE-ADJUSTABLE OVERSHOES FOR GOLF SHOES

BACKGROUND OF THE INVENTION

The present invention relates to overshoes for golf shoes, and more particularly to size-adjustable overshoes for golf shoes.

A golf course often gets wet and muddy in rainy days. Mud covering a golfer's shoes tends to smear or even enter the golf shoes to cause discomfort of the golfer, and the mud on the golf shoes is easily brought into a house to smear the floor. There is one type of overshoes available in the market for wearing over the golf shoes to improve the above-mentioned problems with mud-smeared golf shoes. Such overshoes are made into different sizes to match with differently sized golf shoes. The production of such fixedly sized overshoes is therefore troublesome and golfers need to pick and buy the overshoes carefully to meet the size of their golf shoes. This is, of course, very inconvenient for the golfers to do so.

SUMMARY OF THE INVENTION

A primary object of the present invention is to provide a size-adjustable overshoe for golf shoe, so that golfers need not to take time to pick overshoes that fully match with the size of their golf shoes.

To achieve the object, the overshoe of the present invention mainly includes a sole portion that is in the form of a frame and is cut at suitable positions into several segments. Elastic connecting strips are used to connect these segments to one another, so that the sole portion is elastically expandable and contractible at these connecting strips to adjust its size. When the overshoes according to the present invention is worn over a pair of golf shoes, the elastic connecting strips allow the sole portions of the overshoes to conveniently elastically adjust the size thereof to meet with the size of the golf shoes.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
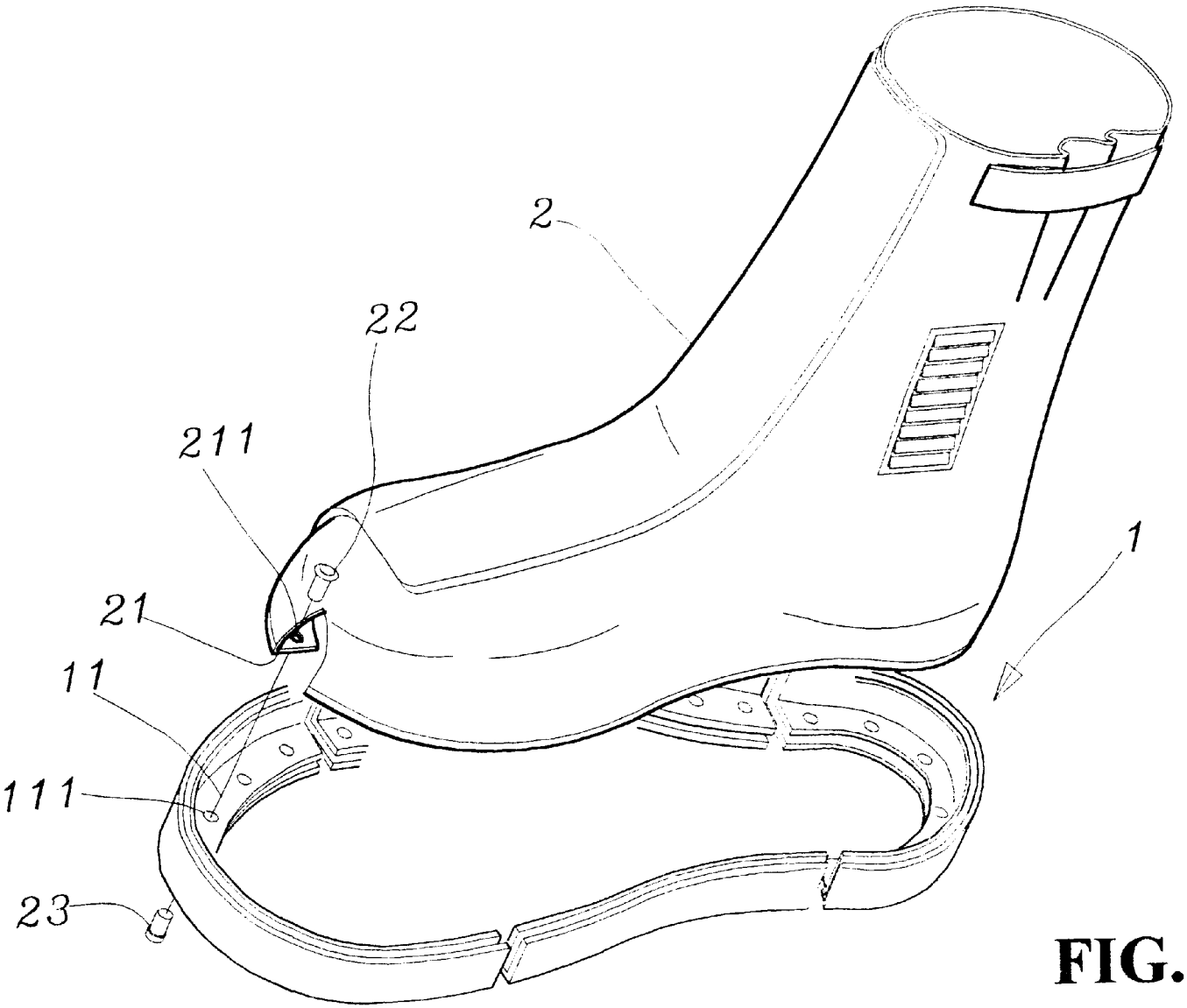
FIG. 1 is an exploded perspective of a size-adjustable overshoe for a golf shoe according to the present invention.
Figure 2:
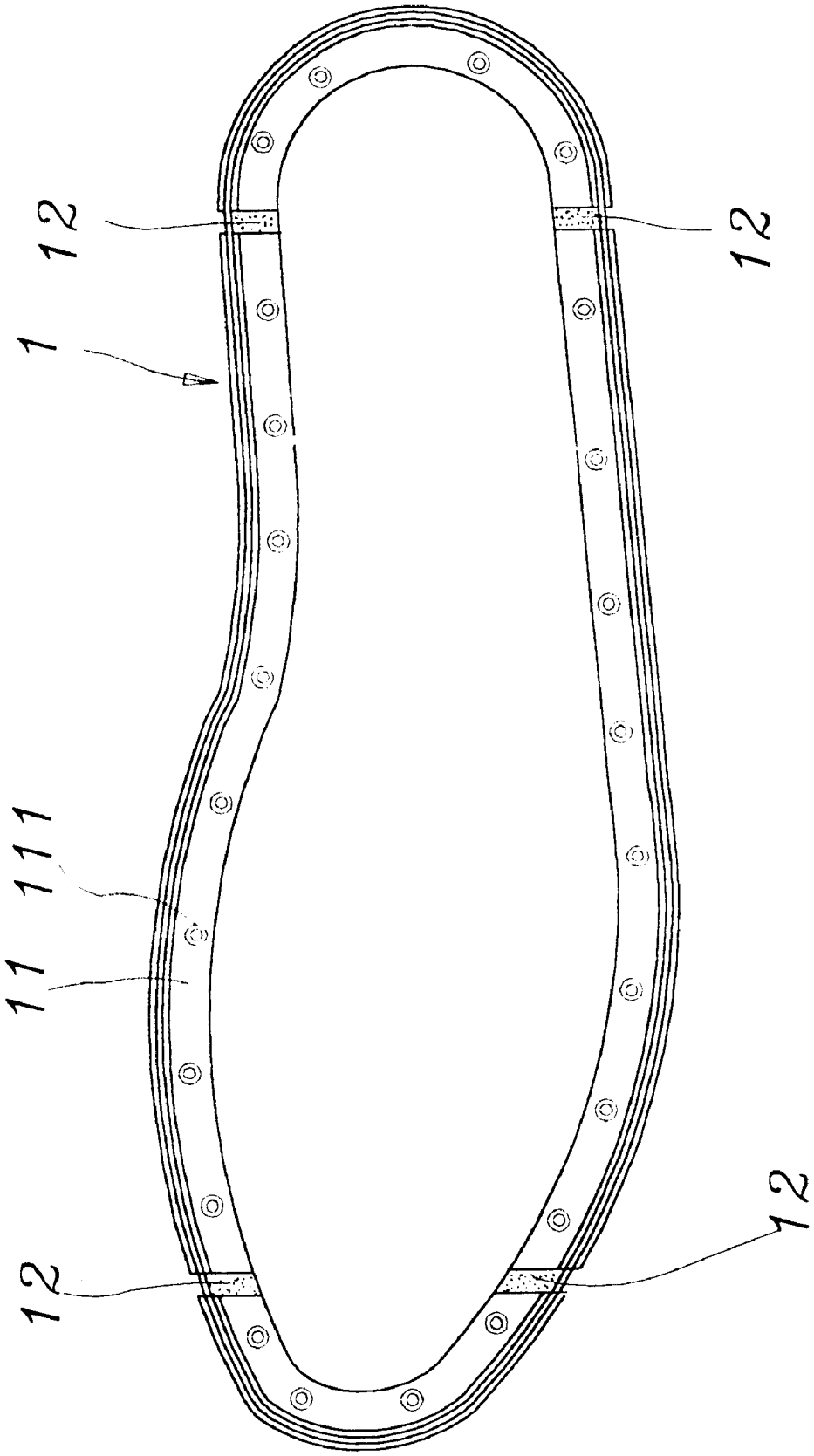
FIG. 2 is a top plan view of a frame-like sole portion of the size-adjustable overshoe of FIG. 1.
Figure 3:
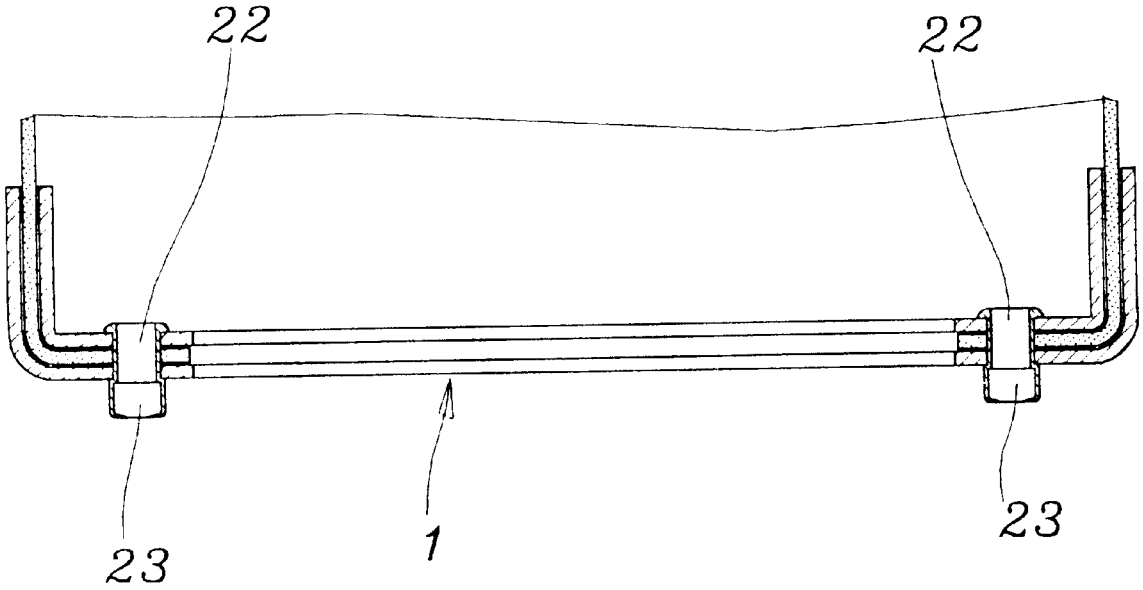
FIG. 3 is a cross sectional view of the size-adjustable overshoe of FIG. 1.

Please refer to FIGS. 1, 2 and 3 in which a size-adjustable overshoe for a golf shoe according to the present invention is shown. The overshoe mainly includes a sole portion 1 in the form of a frame that would be also referred to as a sole frame 1 hereinafter, and a body portion 2.

The sole frame 1 has a contour substantially the same as a general sole. A lower edge of the sole frame 1 inward and horizontally extends to form a fixing flange 11. A plurality of through holes 111 are spaced on the fixing flange 11. The sole frame 1 is cut at predetermined positions into several segments and connecting strips 12 made of suitable elastic material are used at the cut positions to connect the segments of the sole frame 1 to one another. With the elastic connecting strips 12, the sole frame 1 is elastically expandable and contractible and is therefore size-adjustable.

The body portion 2 is in the form of a shoe or boot and has an inward and horizontally projected bottom-flange 21 extended along a lower edge thereof. The bottom flange 21 is provided with a plurality of spaced fixing holes 211 at positions corresponding to that of the through holes 111 on the fixing flange 11 of the sole frame 1. By extending fastening means 22, 23 through the through holes 111 and the fixing holes 211, as shown in FIG. 3, the body portion 2 can be fixedly connected to the sole frame 1 to form the size-adjustable overshoe for golf shoe according to the present invention.

Figure 4:
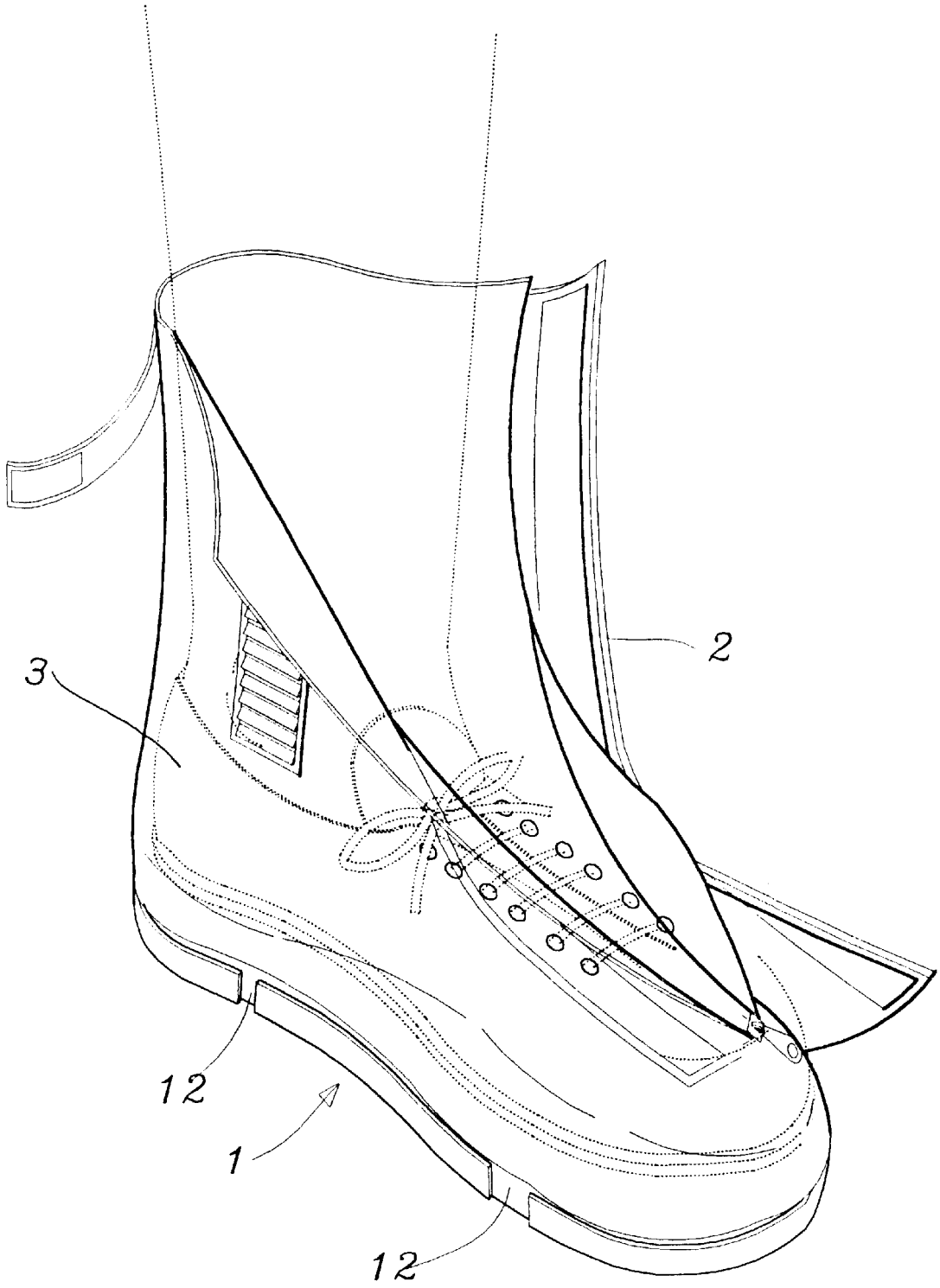
FIG. 4 is a perspective showing the size-adjustable overshoe of FIG. 1 is worn over a golf shoe to protect the latter from getting wet and smeared.

Please now refer to FIG. 4. When a user extends a golf shoe 3 into the body portion 2 of the overshoe, the elastic connecting strips 12 connected to joints of adjacent segments of the sole frame 1 automatically elastically expand to fit the overshoe on the golf shoe. That is, the overshoe of the present invention is elastically size-adjustable for being worn over a golf shoe,of any size.

Figure 5:
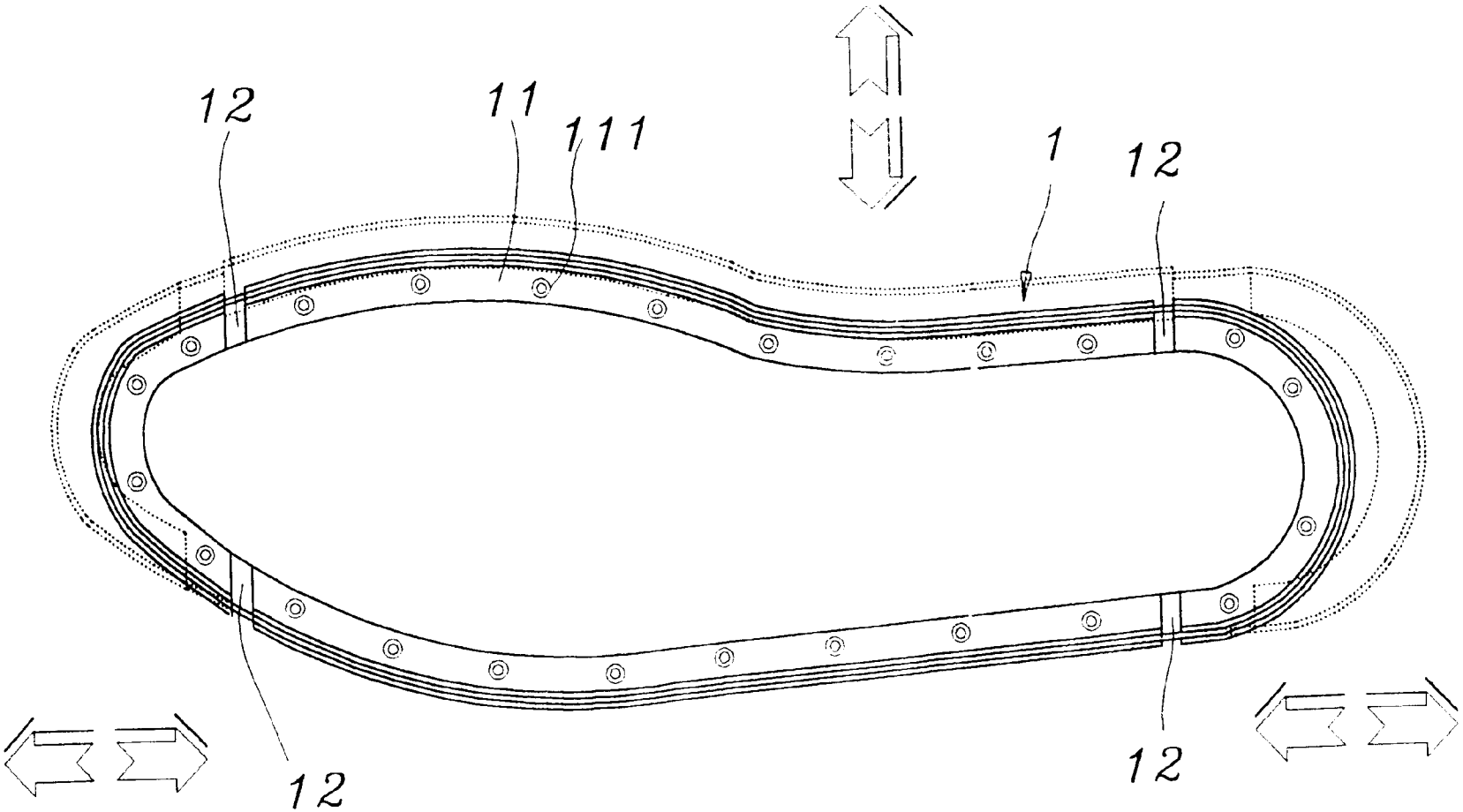
FIG. 5 shows the sole portion of the size-adjustable overshoe of FIG. 1 elastically expands in different directions.

FIG. 5 is a top plan view of the sole frame 1 of the overshoe of the present invention showing the elastic connecting strips 12 connected to joints of adjacent segments of the sole frame 1 elastically expand in different directions to allow adjustment of size of the overshoe for the latter to fit on golf shoes 3 of different sizes. The troublesome problem of selecting overshoes of correct size for golf shoes can therefore be avoided.

What is claimed is:

1. A size-adjustable overshoe for golf shoe, comprising:

a sole portion in the form of a frame having a contour similar to that of a general sole, said frame-like sole portion having a lower edge inward and horizontally extended to form a fixing flange on which a plurality of through holes are spaced, said sole portion being cut at predetermined positions into several segments and connecting strips made of suitable elastic material being used at said cut positions to connect said segments of said sole portion to one another; and a body portion in the form of a shoe or boot and having an inward and horizontally projected bottom flange extended along a lower edge thereof, said bottom flange being provided with a plurality of spaced fixing holes at positions corresponding to that of said through holes on said fixing flange of said sole portion; and said body portion being connected to said sole portion by threading predetermined fastening means through said fixing holes and said through holes;

whereby when said overshoe is worn over a differently sized golf shoe, said elastic connecting strips automatically elastically expand to adjust a size of said overshoe for the same to fit on said golf shoe.

* * * * *